US006583768B1

(12) United States Patent
Underbrink

(10) Patent No.: US 6,583,768 B1
(45) Date of Patent: Jun. 24, 2003

(54) MULTI-ARM ELLIPTIC LOGARITHMIC SPIRAL ARRAYS HAVING BROADBAND AND OFF-AXIS APPLICATION

(75) Inventor: James R. Underbrink, Seattle, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/051,235

(22) Filed: Jan. 18, 2002

(51) Int. Cl.[7] ..... H01Q 21/00

(52) U.S. Cl. ..... 343/893; 343/895; 381/92; 367/905

(58) Field of Search ..... 343/893, 700 MS, 343/895, 769, 770; 381/92; 367/905; H01Q 21/00

(56) References Cited

U.S. PATENT DOCUMENTS 5,175,561 A * 12/1992 Goto ..... 343/769
5,327,146 A * 7/1994 Jeon ..... 343/700 MS
5,838,284 A 11/1998 Dougherty ..... 343/893
6,205,224 B1 3/2001 Underbrink ..... 381/92

* cited by examiner

*Primary Examiner*—Hoanganh Le
(74) *Attorney, Agent, or Firm*—Harness Dickey & Pierce P.L.C.

(57) ABSTRACT

A multi-arm elliptic logarithmic spiral array that is particularly effective in off-axis beamforming applications. The array is formed by providing an elliptic logarithmic spiral and a plurality of concentric ellipses which intersect with angularly spaced apart sample points on the elliptic logarithmic spiral. An odd number of sample points are included on each ellipse. The array of the present invention is particularly effective in off-axis beamforming applications, such as aeroacoustic test applications within wind tunnels, where the location of the array is fixed and the source of noise is positioned off axis of the array.

13 Claims, 9 Drawing Sheets

PRIOR
ART

PRIOR
ART

MULTI-ARM ELLIPTIC LOGARITHMIC SPIRAL ARRAYS HAVING BROADBAND AND OFF-AXIS APPLICATION

TECHNICAL FIELD OF THE INVENTION

This invention relates to planar phased arrays used in source location, source imaging or target illumination applications, and more particularly to a multi-arm, elliptic logarithmic spiral array for providing reduced sidelobe contamination, particularly in applications where off-axis beamforming is required.

BACKGROUND OF THE INVENTION

Phased arrays, and particularly aeroacoustic phased arrays, have become a standard measurement tool for noise engineering. Such phased arrays are frequently used in development tests of various products such as aircraft, and employed in wind tunnels to enable simultaneous aerodynamic and acoustic data acquisition.

The present invention is directed to the problem of designing a planar phased array which is useful across a broad range of frequencies, and where the available number of sensors in the array is restricted such that a regular (i.e., equally spaced element) array cannot be achieved with intra-sensor spacing meeting the half-wavelength criteria typically required to avoid spatial aliasing contamination in source maps or projected beams. A particular problem for such planar arrays is where the primary direction for beamforming is substantially off-axis of the array. This is an especially common problem, for example, for aeroacoustic phased array measurements taken in wind tunnels and fly-over noise measurements. When the phased array is used within a wind tunnel it is commonly placed flush in the wall of the wind tunnel or flat on the ground so that the array orientation is restricted. In such an application, the primary "look" direction will be determined by the position of the model under test with respect to the array position in the wall of the wind tunnel. Beamforming must then be performed off-axis, which reduces the effective aperture of the array. In particular, circular arrays are less effective in beamforming in the off- axis direction and suffer a loss of resolution in the dimension corresponding to the look direction relative to the resolution in the direction perpendicular to the look direction.

It is therefore a principal object of the present invention to provide a planar array that is particularly well adapted to be used in aerocoustic applications where off-axis beamforming is required. More specifically, it is a principal object of the present invention to provide a planar array which is especially well suited to performing off-axis beamforming without suffering reduced resolution in the look direction typically experienced with circular arrays in such applications.

SUMMARY OF THE INVENTION

The above and other objects are provided by a multi-arm, elliptic logarithmic spiral array in accordance with a preferred embodiment of the present invention. The array is formed by first producing an elliptic logarithmic spiral. Next, the elliptic logarithmic spiral is sampled by any one of a number of methods to provide a plurality of sample points angularly spaced apart thereon at which sensors are located. An ellipse is then formed off of each sample point on the elliptic logarithmic spiral such that each ellipse has the same eccentricity as an ellipse that is used to determine a maximum radius of the elliptic logarithmic spiral. All of the ellipses are further formed such that they are concentric with one another.

Finally, each ellipse is sampled with an odd number of equi-angularly spaced samples over a 2 TT angle. Sensors are then placed at each of the sample points. The sampling of each ellipse further begins at that point where the elliptic logarithmic spiral crosses the given ellipse.

The multi-arm, elliptic logarithmic spiral array of the present invention is non-redundant, meaning that no vector spacing between any two sample points (i.e., elements) in the array is repeated. The array of the present invention produces excellent side lobe characteristics over a broad range of frequencies.

The multi-arm, elliptic logarithmic spiral array of the present invention is especially well suited to aerocoustic applications where the primary application is off-axis beamforming. The ellipses of the array are orientated such that their major axes extend along a primary look direction, which is determined by the position of the model under test with respect to the array position. The minor axes of the ellipses are then disposed perpendicular to the look direction. When sensor elements are positioned at the sampling points on each of the ellipses, the array is able to perform off-axis beamforming without the typical reduction in aperture size that occurs with conventional circular logarithmic arrays.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
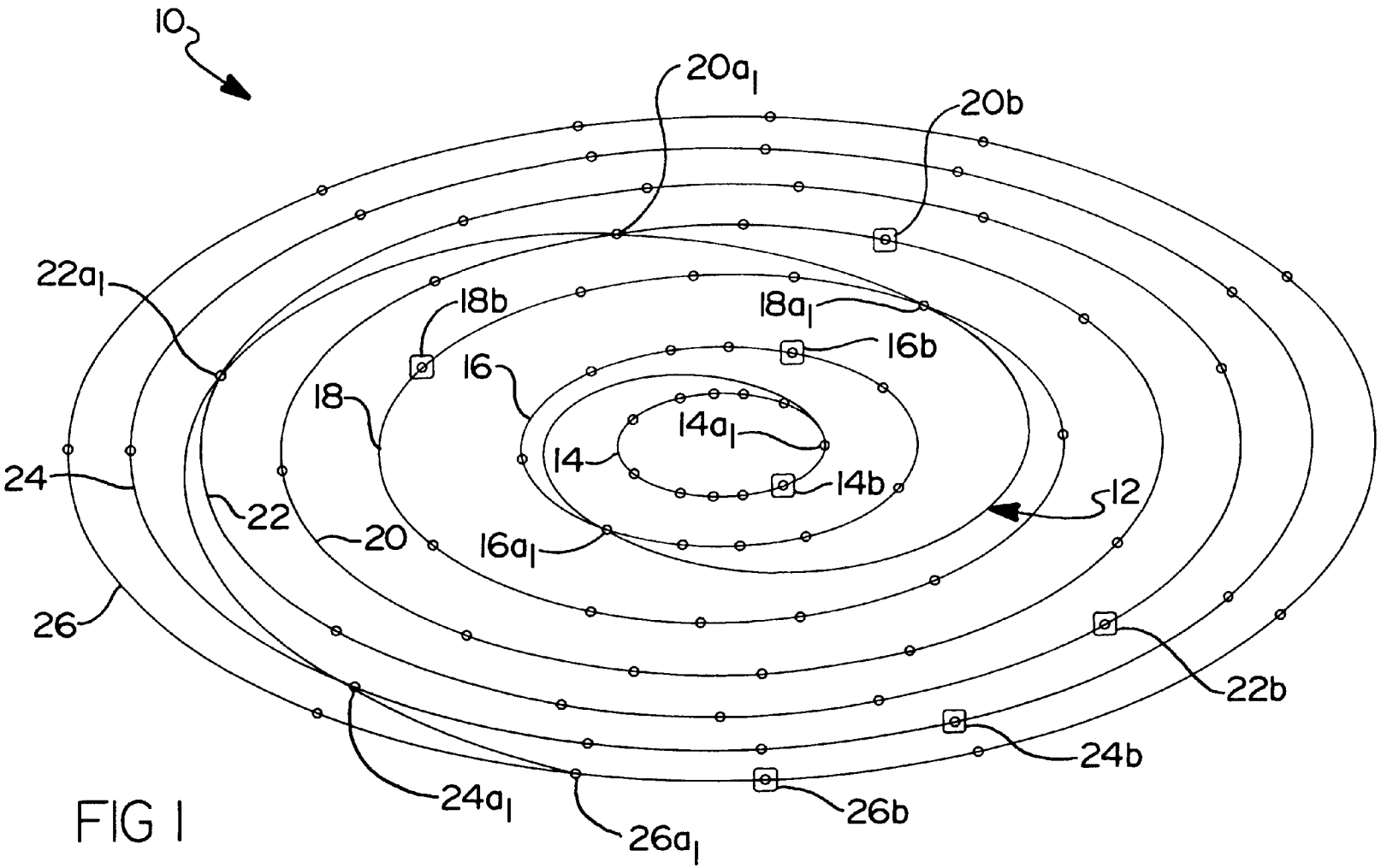
FIG. 1 is a plan view of a multi-arm, elliptic logarithmic spiral array in accordance with a preferred embodiment of the present invention.

Referring to FIG. 1, there is shown a multi-arm elliptic logarithmic spiral array 10 in accordance with a preferred embodiment of the present invention. The array 10 is formed from an elliptic logarithmic spiral 12 that intersects with a plurality of ellipses 14, 16, 18, 20, 22, 24 and 26. Each ellipse 14–26 is further formed with an odd number of sample points. For example, ellipse 14 is formed with an odd number of sample points 14*a*, ellipse 16 is formed with an odd number of sample points 16*a*, and so forth. Furthermore, one of the sample points for each ellipse 14–26 is at the intersection of the given ellipse and the elliptic logarithmic spiral 12, with the intersecting points being denoted by reference numerals $\mathbf{14}a_1$–$26a_1$.

Figure 2:
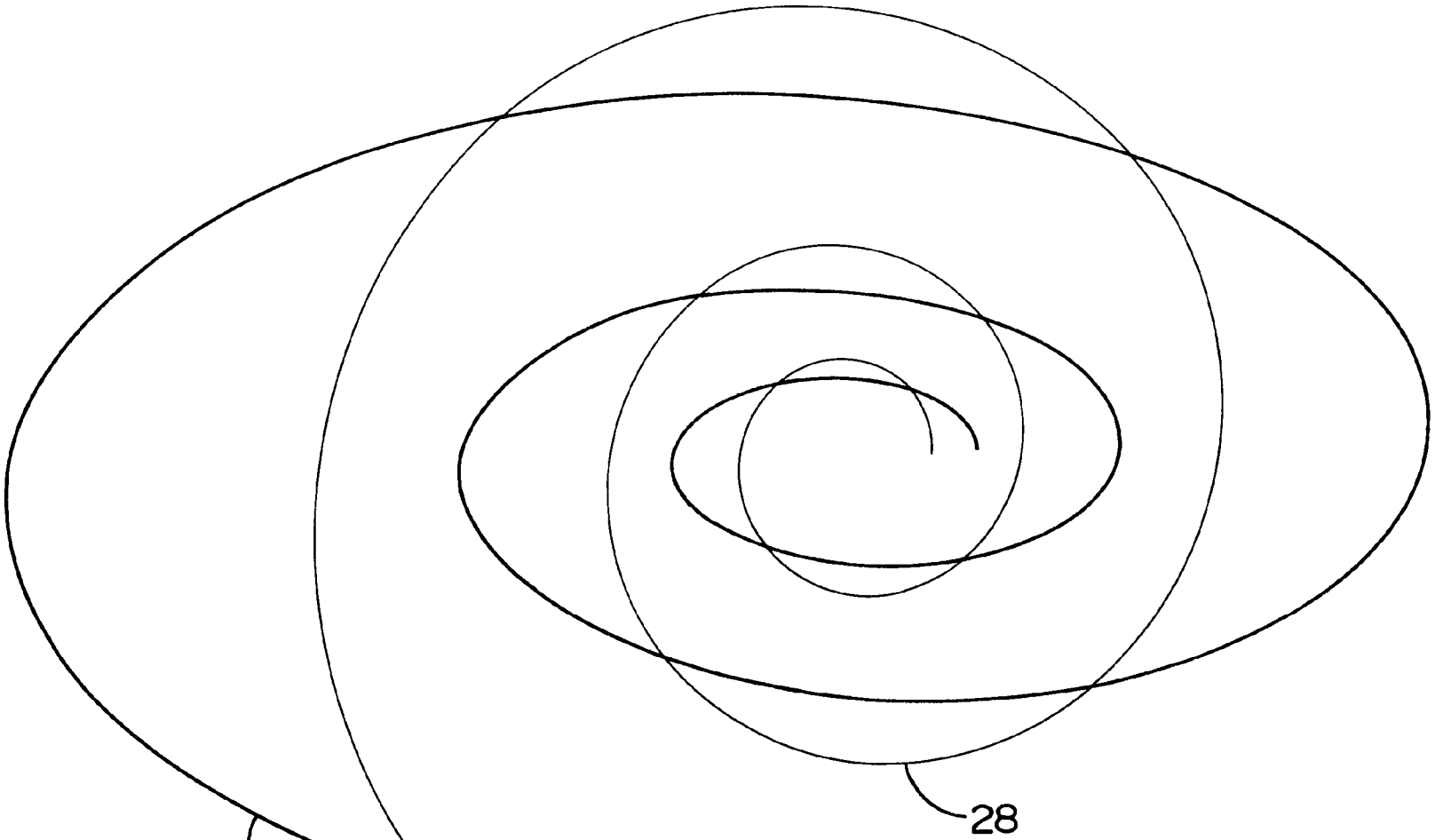
FIG. 2 is a plan view of a prior art circular logarithmic spiral superimposed over an elliptical logarithmic spiral.

The multi-arm elliptic logarithmic spiral array 10 is formed by starting with a logarithmic spiral 28 as shown in FIG. 2. The polar equation for a logarithmic spiral is given by $$r(\theta)=r_o e^{cot(v)\theta} \quad \text{(Equation 1)}$$

where "$r_o$" is the initial radius of the spiral and "v" is the spiral angle. The spiral angle is the angle that a tangent to the spiral makes with a radial line from the origin. The logarithmic spiral is then "warped" into what can be termed an "elliptic logarithmic spiral" indicated by reference numeral 30. The process for warping the logarithmic spiral into an elliptic logarithmic spiral will now be provided.

The design parameters for a logarithmic spiral are $r_o$, $r_{max}$, and v where for a logarithmic-based spiral array $r_{max}$ is selected based on the size of the aperture required to achieve the desired resolution when beamforming. For elliptic-spiral-based arrays described herein, the maximum radius of the spiral is not known a priori. However, the desired elliptic array aperture shape is known and therefore the major and minor axes of the elliptic-shaped aperture are known.

One method of sizing an elliptic array is to orient the major axis of the ellipse in the same plane as the primary look direction for the array. For example, in an aeroacoustic wind tunnel test, the primary look direction is determined by the position of the model under test with respect to the array position in the wall of the wind tunnel. The minor axis of the ellipse will then be perpendicular to the look direction. Since the minor axis is perpendicular to the look direction, it will not suffer from an effective reduction in aperture size. The minor axis can thus be selected to provide the desired resolution when beamforming. The major axis will be effectively reduced to:

$$A'=A\cos(\phi) \quad \text{(Equation 2)}$$

Where "$A^1$" is the effective aperture size, "A" is the actual aperture size, and "ϕ" is the look angle, (i.e. the angle off broadside used for beamforming). If the minor axis is chosen to be D, then if the major axis is chosen to be D/cos(ϕ), the effective aperture will be D for both axes and a symmetrical beammap will be formed.

Given the minor axis dimension D, the major axis dimension D/cos(ϕ) and a selected spiral angle v, the maximum radius of the spiral rmaxand the corresponding polar angle $\theta_{max}$ may be determined by simultaneously solving the polar equation for the spiral (in terms of $r_{max}$ and $\theta_{max}$:

$$r_{max}=r_o e^{cot(v)\theta_{max}} \quad \text{(Equation 3)}$$

and for the equation for the ellipse:

$$\frac{x^2}{(D/\cos\phi)^2}+\frac{y^2}{D^2}=1 \quad \text{(Equation 4)}$$

in polar coordinates (in terms of $r_{max}$ and $\theta_{max}$).

$$\frac{r_{max}^2\cos^2(\theta_{max})}{(D/\cos\phi)^2}+\frac{r_{max}^2\sin^2(\theta_{max})}{D^2}=1 \quad \text{(Equation 5)}$$

To solve simultaneously, Equation 5 above is solved for rmax and set equal to Equation 3 as follows:

$$\frac{D}{\sqrt{\cos^2(\theta_{max})\cos^2(\phi)+\sin^2(\theta_{max})}}=r_o e^{\cot(v)\theta_{max}} \quad \text{(Equation 6)}$$

Equation 6 above may be re-written as, $$r_o{}^2 e^{2cot(v)\theta}{}_{max|cos}{}^2(\theta_{max)cos}{}^2(\phi)+\sin^2(\theta_{max})|-0 \quad \text{(Equation 7)}$$

Equation 7 above can then be solved for $\theta_{max}$ numerically with a root finder. Now, enough information exists to form a logarithmic spiral with the appropriate maximum radius such that when the ellipse with minor axis D and major axis D/cos(ϕ) is formed it will pass through the terminal point ($r_{max}$,$\theta_{max}$) of the logarithmic spiral.

To form the elliptic logarithmic spiral, the radial coordinate of the logarithmic spiral is multiplied at each point ($r_s$,$\theta_s$) by the factor:

$$r_e=\frac{r_p}{r_{max}} \quad \text{(Equation 8)}$$

where $r_p$ is the radial coordinate of the ellipse with minor axis D, and major axis D/cos(ϕ) at the angle $\theta_s$.

Equation 5 above can be used to calculate $r_p$ by substituting $r_p$ for $r_{max}$ and $\theta_s$ for $\theta_{max}$ and solving the following equation $$r_p=\frac{D}{\sqrt{\cos^2(\theta_s)\cos^2(\phi)+\sin^2(\theta_s)}} \quad \text{(Equation 9)}$$

The elliptic logarithmic spiral as created above now forms the basis for the multi- arm elliptic logarithmic spiral array 10 shown in FIG. 1.

The multi-arm elliptic logarithmic spiral array is formed in accordance with the following steps:

1. Create an elliptic logarithmic spiral;
2. Sample the elliptic logarithmic spiral by any of a number of methods such as those described in U.S. Pat. No. 6,205,224, hereby incorporated by reference;
3. Form an ellipse off each sample point on the spiral that has the same eccentricity as the ellipse used to determine the maximum radius of the elliptic logarithmic spiral; and
4. Sample each ellipse with an odd number of equiangularly spaced samples over a 2 TT angle.

The ellipses 14–26 shown in FIG. 1 are formed in step 3 above using equation 9 to determine the minor axes for the elliptic logarithmic sample point ($r'_s$,$\theta_s$):

$$D_s=r_s\sqrt{\cos^2(\theta_s)\cos^2(\phi)+\sin^2(\theta_s)} \quad \text{(Equation 10)}$$

where $r'_s=r_e r_3$.

Then the ellipse is formed using the following equation:

$$r = \frac{D_s}{\sqrt{\cos^2(\theta)\cos^2(\phi) + \sin^2(\theta)}} \quad \text{(Equation 11)}$$

The sampling of each ellipse 14–26 in step 4 above starts at $\theta_s$, where the elliptic logarithmic spiral crosses the given ellipse. An odd number of samples are equi-angularly spaced from $\theta_s$ to $\theta_s+2\pi$.

The multi-arm elliptic logarithmic spiral array is further non-redundant, meaning that no vector spacing between any two elements in the array is repeated. Non-redundant arrays are known to produce excellent sidelobe characteristics over a broad range of frequencies.

With further reference to FIG. 1, the elliptic logarithmic spiral 12 is sampled at a plurality of points 14$a_1$, 16$a_1$, 18$a_1$, 20$a_1$, 22$a_1$, 24$a_1$ and 26$a_1$ according to a strategy where each sample occupies an equi-annular region of a disk excluding the innermost sample 14*a*. Sample 14*a* is chosen independently to prevent a large unsampled region at the center of the array 10 and to provide for additional small spatial separations between array elements 14*b* disposed at sample points 14*a*. It will be appreciated that array elements 16*b*–26*b* (i.e., sensors or transmitting elements) are also disposed at sample points 16*a*–26*a*, respectively. The additional small spacings between array elements also improves array 10 performance at higher frequencies. Ellipses 14–26 cut through each elliptic logarithmic spiral sample point (i.e., sample points 14*a*,–26*a*,). The ellipses 14–26 are each sampled with an odd number of equi-angularly spaced samples.

Figure 3:
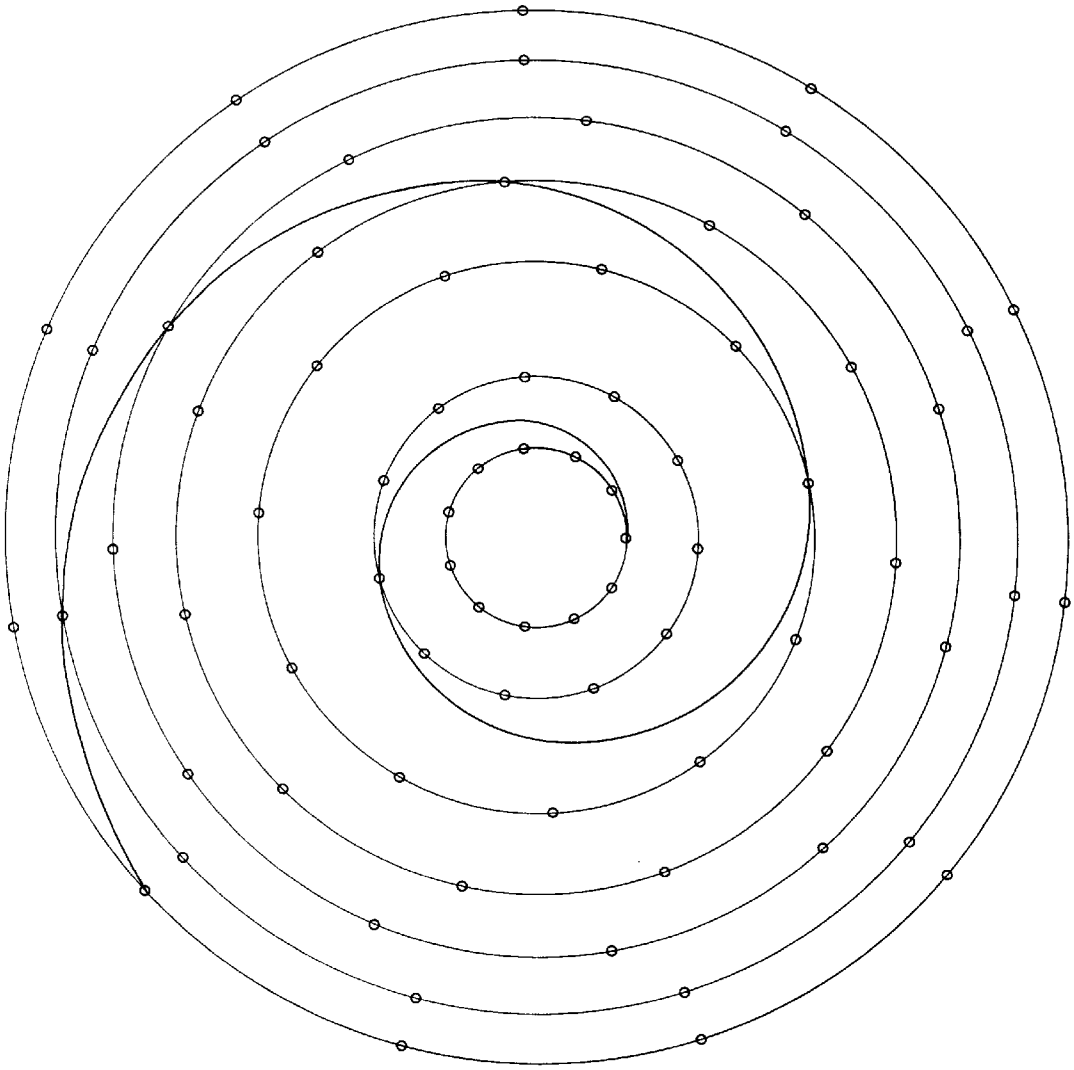
FIG. 3 is a is a prior art plan view of a multi-arm spiral array.

To appreciate how the multi-arm elliptic logarithmic spiral array 10 performs, it is helpful to first see the performance of a known, multi-arm spiral array, such as shown in FIG. 3. The radius of the multi-arm spiral array shown in FIG. 3 is the same as the minor axis of the array 10 shown in FIG. 1 (FIGS. 1 and 3 are not drawn to the same scale). The number of elements is the same for both arrays.

Figure 4:
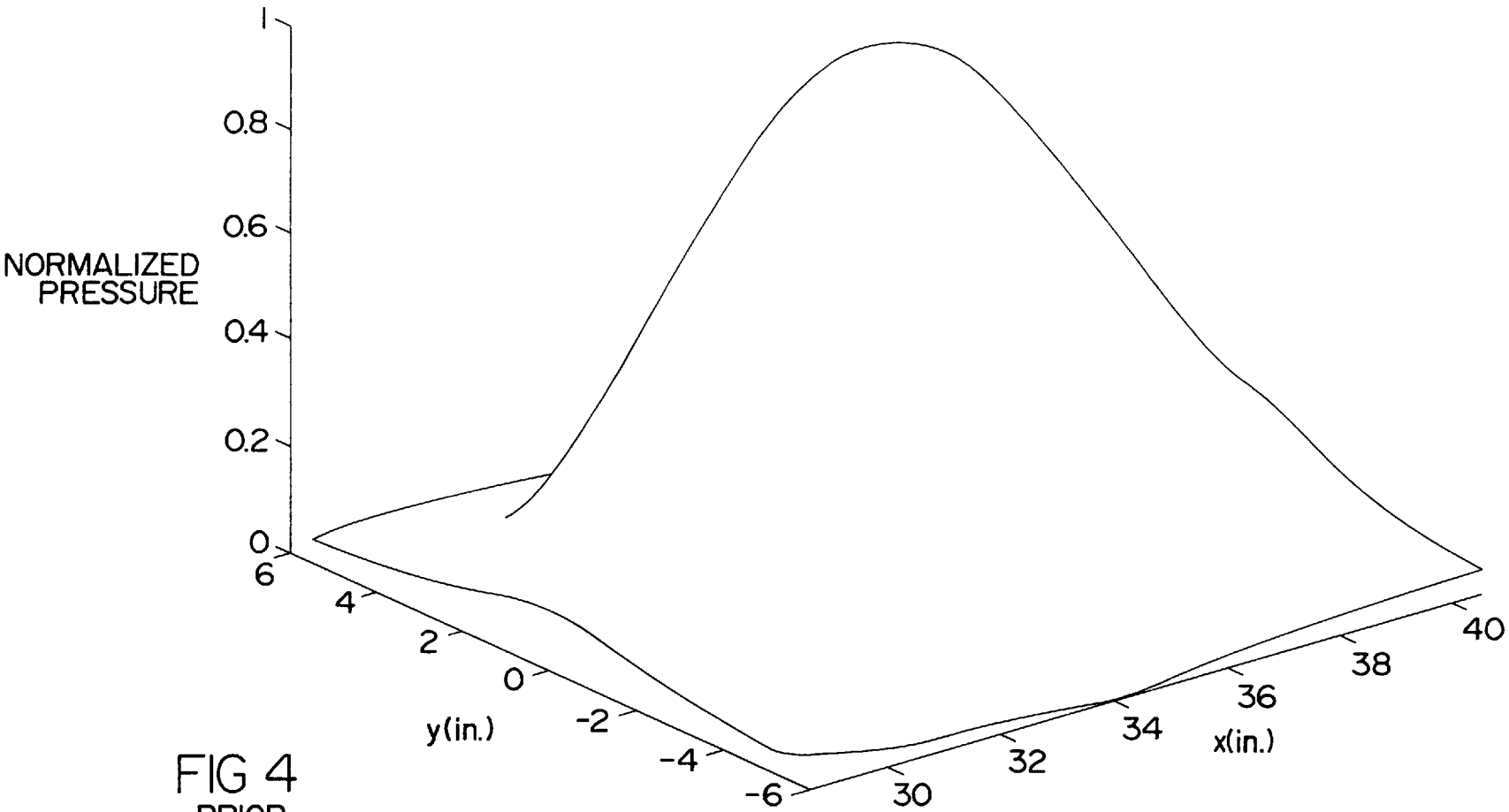
FIG 4 PRIOR ART
FIG. 4 is an array pattern at 10 KHz for the array of FIG. 3.
Figure 5:
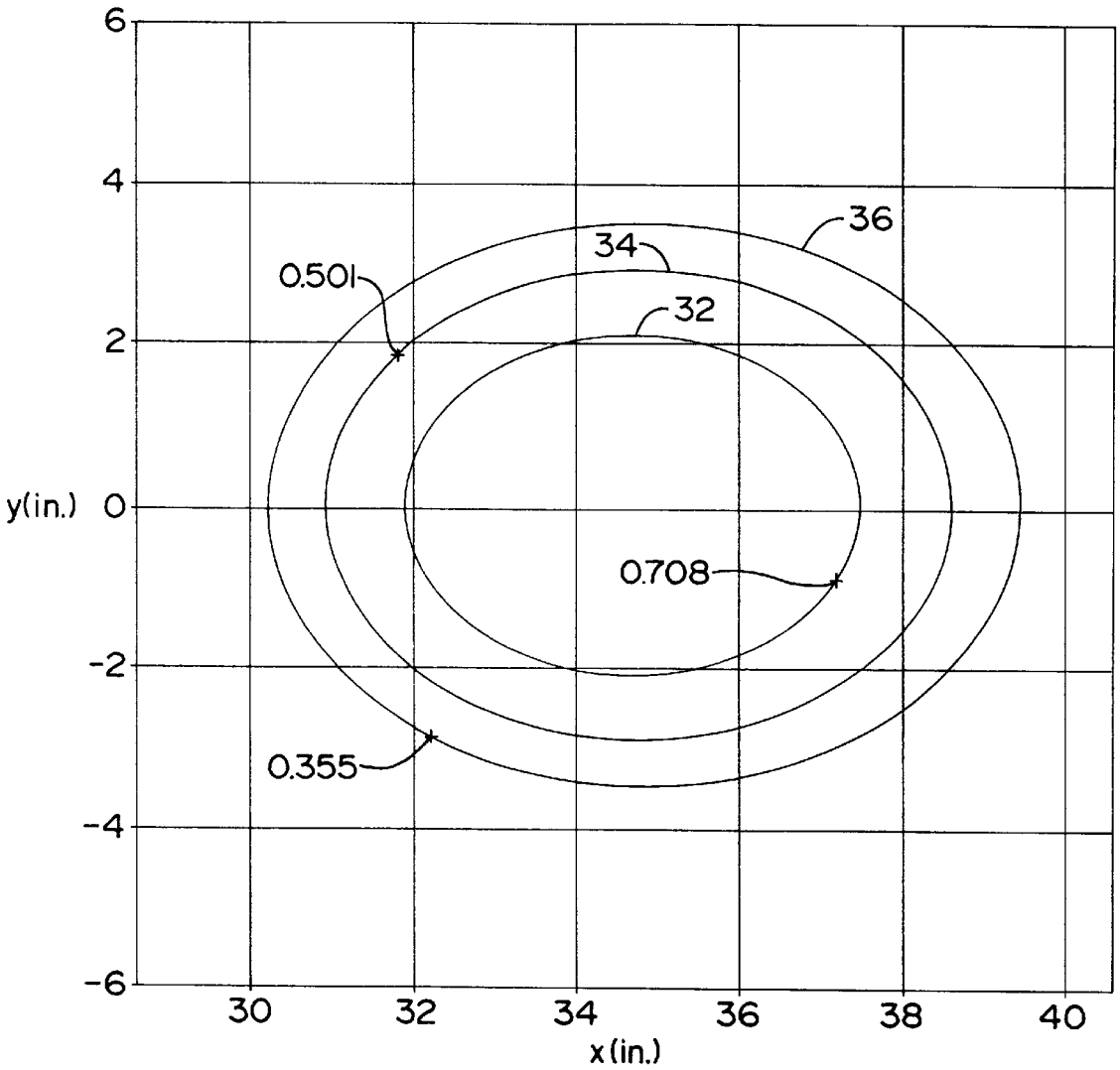
FIG. 5 is a graph of the 3, 6, and 9 dB down contours for the array pattern of FIG. 4.

Referring to FIG. 4, an array pattern is shown at 10 KHz for the array of FIG. 3. The array pattern is produced by analytically beamforming for a point source located at (34.6, 0, 60) relative to the array center, which corresponds to 30 degrees off the array axis in the X-direction (with the array of FIG. 3 being assumed to be centered at the origin in the X–Y plane). Three, six and nine dB down contours 32, 34 and 36, respectively for the array pattern of FIG. 4 are shown in FIG. 5. The elliptic shape of the contours reveals that the resolution in the X-dimension is significantly less than that of the Y-dimension. This is the effect from scanning off-axis of a circular aperture array.

Figure 6:
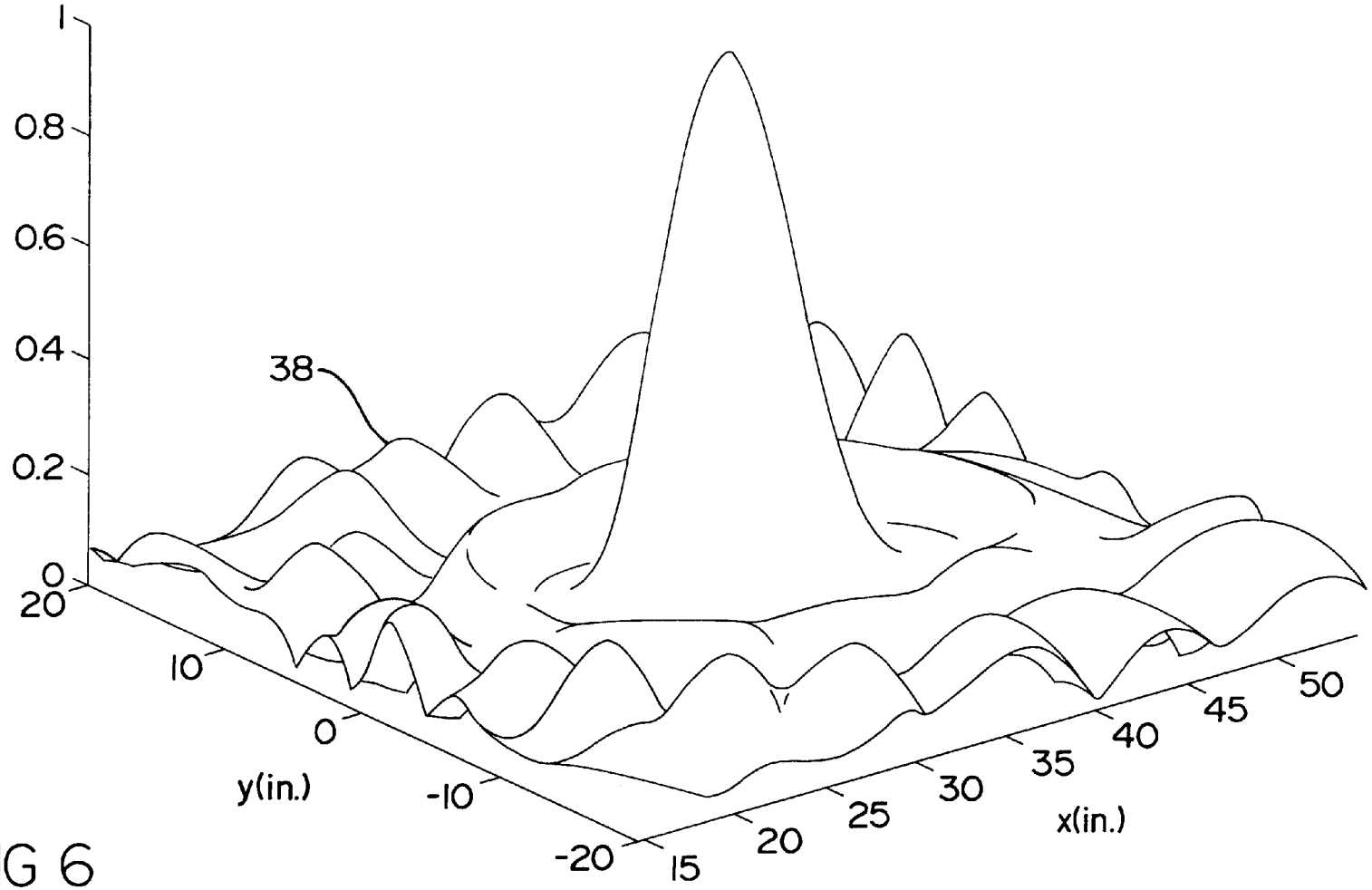
FIG 6 PRIOR ART
FIG. 6 is an array pattern at 10 KHz for the array of FIG. 3.

FIG. 6 illustrates an array pattern from the same array and source location as used in FIG. 4. In FIG. 6, a much larger scan plane was used 40 by 40 inches vs. 12 by 12 inches to illustrate the typically excellent plateau-like sidelobes 38 of the array of FIG. 3.

Figure 7:
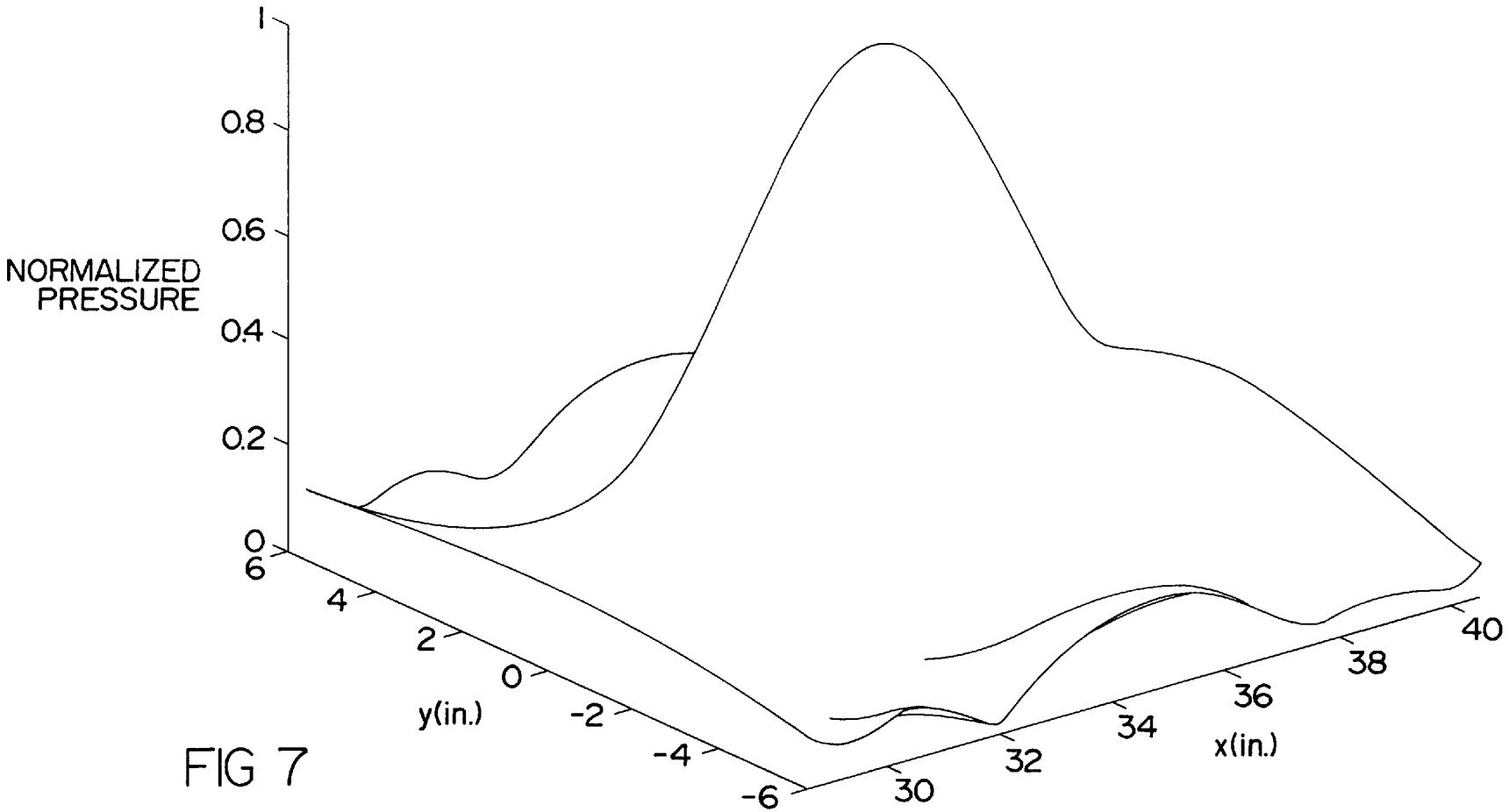
FIG. 7 is an array pattern at 10 KHz for the array of FIG. 1.
Figure 8:
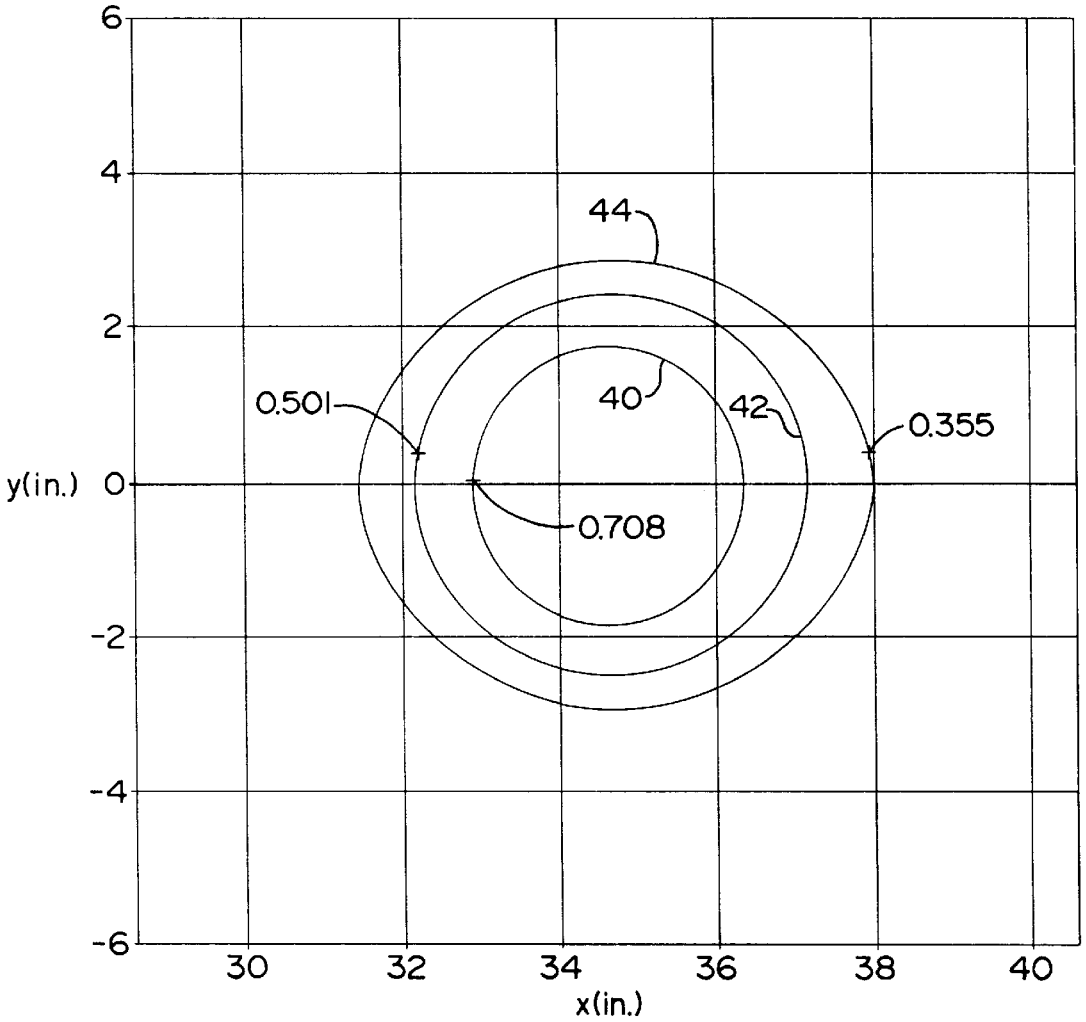
FIG. 8 is a graph of the 3, 6, and 9 dB down contours for the array pattern of FIG. 7.

FIG. 7 illustrates an array pattern for the array 10 shown in FIG. 1 which is produced by analytically beamforming for a point source located at (34.6, 0, 60) relative to the array center, which correspondence to 30 degrees off the array axis in the X-direction (with the array 10 being assumed to be centered at the origin in the X-Y plane). Three, six and nine dB down contours 40, 42, 44, respectively for the array pattern of FIG. 7 are shown in FIG. 8. Note the circular shape of the contours showing that the resolution in the X-dimension is comparable to that of the Y-dimension. This is the desired effect provided by the multi-arm elliptic logarithmic spiral array 10 of the present invention.

Figure 9:
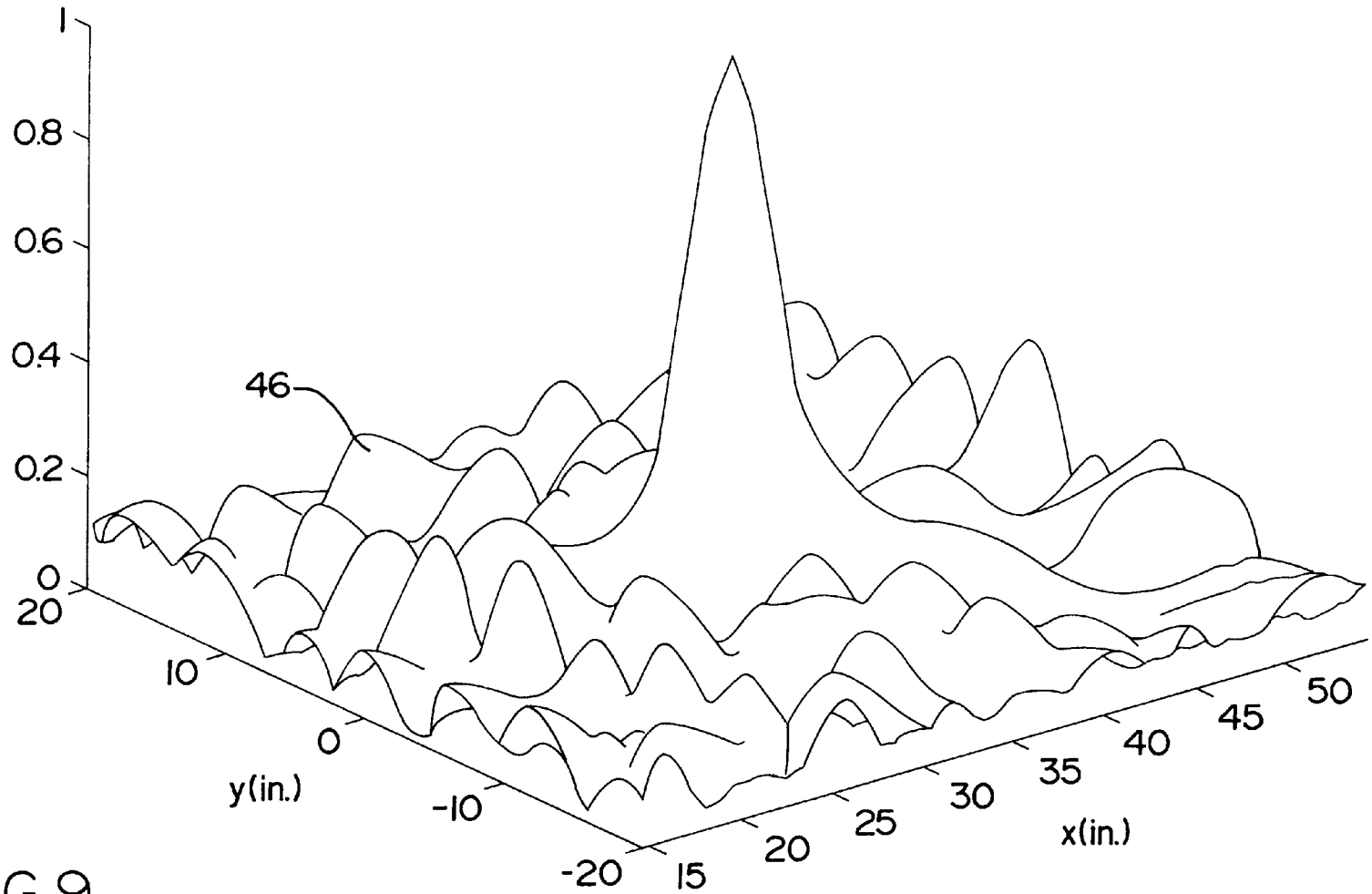
FIG. 9 is an array pattern at 10 KHz for the array of FIG. 1.

FIG. 9 illustrates an array pattern from the array 10 and source location as used in FIG. 7. In FIG. 9, a much larger scan plane was used 40 by 40 inches vs. 12 by 12 inches to illustrate the typically excellent plateau-like sidelobes 46 of the present invention. The sidelobe characteristics are very similar to those shown in FIG. 6 in that they are still plateau-like. The improvement in resolution between the beammaps of FIGS. 6 and 9 is apparent.

One preferred arrangement for deploying a plurality of multi-arm elliptic logarithmic spiral arrays is to deploy a plurality of the arrays at desired emission angle measurement positions. Such positions could be, for example, along the wall of a low speed aerodynamic wind tunnel. Because the arrays 10 are restricted to the wall of the tunnel, the distances from the arrays 10 to the scan region of interest will vary significantly. The minor axis of each array 10 can be sized independently to ensure common source resolution across all the arrays 10. The major axis of each array 10 can then be sized based on the off-axis beamform angle to provide equal resolution in both dimensions.

The multi-arm elliptic logarithmic spiral array 10 thus provides a means for providing off-axis beamforming in a manner which provides common resolution in both the look direction and perpendicular to the look direction and provides plateau-like sidelobe suppression for a broad range of frequencies. The array 10 of the present invention is expected to find particular utility in connection with aerospace related testing activities, in automotive applications involving noise testing of vehicles within wind tunnels, and virtually any aerocoustic test application where noise source identification is important. Other possible applications are those where off-axis beamforming is necessary.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A non-redundant planar array for reducing sidelobes in at least one of source maps and projected beams during beam forming, said array comprising:

an elliptical logarithmic spiral having a plurality of sample points spaced apart thereon;

a plurality of multi-arm elliptic logarithmic arrays formed by a plurality of ellipses, wherein said ellipses are each formed off of a respective one of said sample points on said elliptical logarithmic spiral so as to each intersect a respective one of said sample points;

wherein each said ellipse includes an odd number of equi-angularly spaced sample points; and wherein a plurality of array elements are disposed at said sample points.

2. The array of claim 1, wherein said ellipses are formed concentrically with one another.

3. The array of claim 1, wherein each said ellipse includes an odd number of equi-angularly spaced sample points over a 2 TT angle.

4. The array of claim 1, wherein each said ellipse has a major and a minor axis, and wherein said major axes are all orientated in a direction in accordance with a primary look direction of the array, and wherein minor axes of each said array are orientated perpendicular to said major axes.

5. A non-redundant planar array for reducing sidelobes in source maps or projected beams during off axis beam forming, said array comprising:

an elliptical logarithmic spiral having a plurality of sample points spaced apart thereon;

a plurality of multi-arm elliptic logarithmic arrays formed by a plurality of ellipses, wherein said ellipses are each formed off of a respective one of said sample points on said elliptical logarithmic spiral so as to each intersect a respective one of said sample points;

wherein each said ellipse includes an odd number of equi-angularly spaced sample points and said ellipses are disposed concentrically with one another; and wherein a plurality of array elements are disposed at said sample points.

6. The array of claim 5, wherein each said ellipse has an eccentricity in accordance with an eccentricity of an ellipse used to determine a maximum radius of said elliptical logarithmic spiral.

7. The array of claim 5, wherein each said ellipse includes an odd number of equi-angularly spaced sample points over a 2 TT angle.

8. The array of claim 5, wherein each said ellipse has a major and a minor axis, and wherein said major axes are all orientated in a direction in accordance with a primary look direction of the array, and wherein minor axes of each said ellipse are orientated perpendicular to said major axes.

9. A method for forming a non-redundant planar array having reduced sidelobes in source maps or projected beams during off axis beam forming, said method comprising:

forming an elliptical logarithmic spiral having a maximum desired radius;

selecting a plurality of angularly spaced apart sample points on said elliptical logarithmic spiral;

forming a plurality of multi-arm elliptic logarithmic arrays via a plurality of ellipses, wherein said ellipses are each formed to intersect a respective one of said sample points on said elliptical logarithmic spiral;

including an odd number of equi-angularly spaced sample points on each said ellipse; and disposing an array element at a plurality of said sample points.

10. The method of claim 9, further comprising arranging said ellipses concentrically with one another.

11. The method of claim 9, further comprising providing each said ellipse with an eccentricity in accordance with an eccentricity of a reference ellipse used to determine a maximum radius of said elliptical logarithmic spiral.

12. The method of claim 9, further comprising:

forming each said ellipse with a major axis and a minor axis, and wherein said major axes are all orientated in a direction in accordance with a primary look direction of the array, and wherein minor axes of each said ellipse are orientated perpendicular to said major axes.

13. The method of claim 9, further comprising spacing said sample points over a 2 TT angle on each said ellipse.

* * * * *